United States Patent [19]

Fog et al.

[11] 4,430,922

[45] Feb. 14, 1984

[54] GUN-MOUNT FOR MACHINE GUNS OR WEAPONS OF A SIMILAR KIND

[75] Inventors: Jorgen L. Fog, Skovlunde; Jorgen Nielsen, Farum, both of Denmark

[73] Assignee: Disa A/S (Dansk Industri Sundikat A/S), Denmark

[21] Appl. No.: 270,389

[22] Filed: Jun. 4, 1981

[30] Foreign Application Priority Data

Jun. 10, 1980 [DK] Denmark ..... 2502/80

[51] Int. Cl.[3] ..... F41F 21/02

[52] U.S. Cl. ..... 89/37 H; 248/282; 248/647

[58] Field of Search ..... 89/37 B, 37 BA, 37 H; 248/122, 124, 282, 283, 284, 647

[56] References Cited

U.S. PATENT DOCUMENTS

| | | | |
|---|---|---|---|
| 662,761 | 11/1900 | Bowman et al. | 89/37 H |
| 1,223,085 | 4/1917 | Manierre | 248/283 |
| 2,345,747 | 4/1944 | Hake | 248/282 |
| 2,690,896 | 10/1954 | Bissell et al. | 248/647 |

FOREIGN PATENT DOCUMENTS

| | | | |
|---|---|---|---|
| 131211 | 6/1975 | Denmark . | |
| 133484 | 5/1976 | Denmark . | |
| 564392 | 9/1944 | United Kingdom | 89/37 B |
| 1475712 | 6/1977 | United Kingdom . | |

*Primary Examiner*—Stephen C. Bently

*Attorney, Agent, or Firm*—Klarquist, Sparkman, Campbell, Leigh & Whinston

[57] ABSTRACT

A gun-mount for machine guns or weapons of a similar kind comprises two mutually hinged swivel arms (2,3) in staggered position the one at a higher level than the other, the lower (2) of said arms at its free end being pivotally embedded around a vertical pivot journal (4), which may be mounted e.g. on the roof of a motor vehicle at the edge of a gun pit, while the other, which is mainly formed as a vertically adjustable parallelogram connection, has fittings at its free end for pivotal fastening of a fork (14) for swivel action of a weapon.

The gun-mount has means for releasable locking of the two swivel arms in an arbitrary mutually revolving position of these. This kind of gun-mount permits the use of guns of a relatively large calibre, as the force of recoil of the weapon cannot be transferred to the gunner through the swivel arms (2,3).

8 Claims, 2 Drawing Figures

GUN-MOUNT FOR MACHINE GUNS OR WEAPONS OF A SIMILAR KIND

Figure 1:
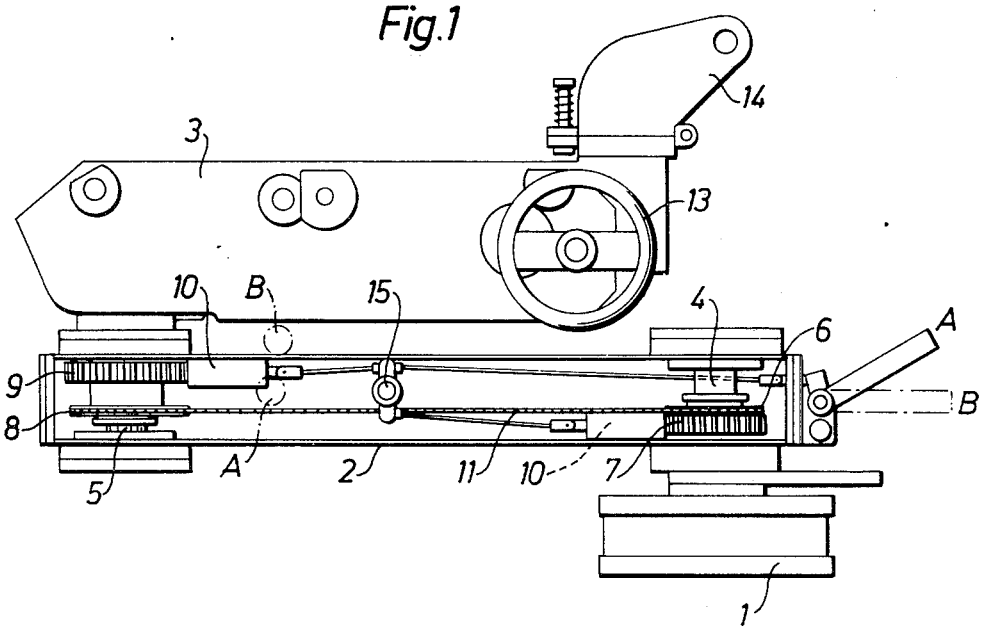

This invention relates to a gun-mount for machine guns or weapons of a similar kind, which mount comprises two mutually hinged swivel arms in staggered position the one at a higher level than the other, one of said arms at its free end being pivotally embedded around a vertical pivot journal (pivot bearing), which may be mounted e.g. on the roof of a motor vehicle at the edge of a gun pit, while the other, which is appropriately formed as a vertically adjustable parallelogram connection, has fittings at its free end for pivotal fastening of a fork for swivel action of a weapon.

Gun-mounts of this kind are known from the Danish Patent Specification Nos. 131,211 and 133,484. These known gun-mounts enable the gunner to fire rapidly and comfortably-without moving-in widely different directions with the weapon supported by the gun-mount, without the weight of the weapon burdening the gunner to any large extent as e.g. in the case of detached firing, irrespective of the fact that the freedom of direction is almost the same.

However, according to the Danish Patent Specification No. 133,484 the gun-mount can only be used advantageously for relatively light guns, as the force of recoil of the weapon is transferred through the swivel arms without substantial dampening, as the two swivel arms can be turned freely independently of each other.

In a gun-mount according to the Danish Patent Specification No. 131,211 an interdependence between the swing positions of the two swivel arms during the turning of the swivel arm system around the vertical pivot axis by means of an articulated rod has been achieved, said rod at its one end close to the hinged connection between the swivel arms being hinged to the other swivel arm or an arm or corresponding part rigidly connected with same, and at its other end being hinged to a firm point close to the pivot bearing of the first swivel arm, which point lies on the connecting line between said pivot bearing and the center of the gun pit, so that in this manner an articulated rod square is formed serving for the forced steering of the angle between the swivel arms dependent on the swing of the first swivel arm. In this articulated rod square the first swivel arm forms the square side lying opposite the above-mentioned articulated rod, and furthermore the dimensions of the articulated rod square are adapted such that the length of the square side represented by the distance between the pivot of the first swivel arm and the firm hinged point of the articulated rod plus the length of the square side represented by the first swivel arm are substantially equal to the total length of the two other square sides. In this manner, a forced steering of the second swivel arm is obtained in relation to the first one, where the position of the hinged connections of the articulated rod in relation to the hinge between the swivel arms and the pivot axis determines the steering operation. With this articulated rod connection, a tolerable agreement with the desired circular form can be obtained by turning the swivel arm system up to at least 180° from O-position.

However, also in the case of a gun-mount according to the Danish Patent Specification No. 131,211 the force of recoil is transferred from the gun fork to the lower swivel arm through the upper swivel arm, which is appropriately formed as a parallelogram connection to make it possible to adjust the height. The gun-mount known from the Danish Patent Specification No. 131,211 with the freely pivotal articulated rod connection cannot in itself prevent the force of recoil from heavy guns being transferred through the rod system affecting the swing motion of the gun-mount with the consequent inconvenience, especially when shooting at targets on the ground.

The purpose of the invention is a further development of the known gun-mounts permitting the use of guns of a relatively large calibre, which in practice means calibres over 10.0 mm, without the gunner loosing the possibility of maintaining his aim and thus avoiding the risk of the gunner being unable to shoot.

According to the invention, this purpose is achieved using a gun-mount of the type mentioned in the introduction, and characterized in that means are provided for releasable locking of the two swivel arms in an arbitrary mutually revolving position.

As in the case of hitherto known gun-mounts, this measure enables the gunner easily to place the weapon in the desired firing position, when the locking of the two swivel arms is released, and then fire against the target, when the swivel arms are locked, as in this position the swivel arms will not be capable of turning in relation to each other.

The gun-mount according to the invention, where the hinged connection between the swivel arms is an axle journal, pivotally embedded in the two arms, the means for releasable locking of the swivel arms can be ratchet wheels fastened on the axle journal and the pivot journal respectively, as well as ratchets activated through a rod mechanism.

In this manner, both the axle journal and the pivot journal are blocked by activation of one and the same rod mechanism, as the ratchets prevent a turning of the ratchet wheels that are rigidly connected with the journals. Thus, the swivel arms can neither turn mutually nor around the pivot journal, when the ratchets by means of the rod mechanism intermesh with the ratchet wheels.

In an embodiment preferred in practice the rod mechanism consists of two rods one end of which being rotatably fastened to an axle pivotally embedded in the lower swivel arm, the other end being linked to a ratchet pressed against the ratchet wheel by spring force. It is thus possible to activate the rod mechanism by one single turn of the pivotally embedded axle.

According to the invention, the free ends of the pivotal axle can be provided with grips to be used when turning the axle for releasing or locking the ratchets in the ratchet wheels, as the axle co-acts with a locking device, which is designed to keep the axle in the position in which the ratchets block the ratchet wheels respectively in the position in which the ratchets are not intermeshed with the ratchet wheels.

In this manner, the gunner will be able to operate the pivotal axle easily, irrespective of whether the swivel arm system is turned to one side or the other in relation to the gun pit, and the locking device results in a smooth operation, as the grips only have to be moved between two well-defined endstops.

In accordance with a preferred embodiment, a further grip has been mounted at the end of the lower swivel arm facing away from the hinged connection. This grip is connected with the pivotal axle by an articulated rod. Thereby, the gunner can operate the rod mechanism for releasable locking of the swivel arms, even though the swivel arms are in a mutually rotatable position, in which the swivel arms lie practically end to end, so that the pivotal axle is furthest away from the gunner (FIG. 2).

Figure 2:
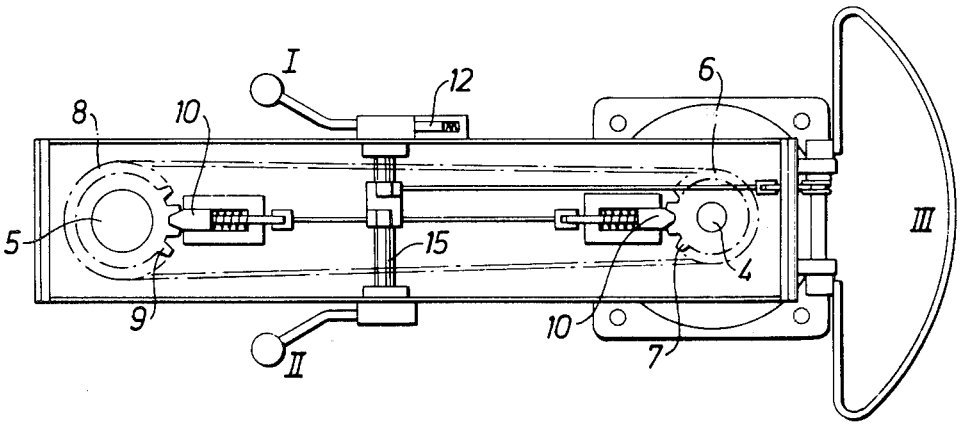

In the following, the invention will be further explained with reference to the drawing, in which FIG. 1 is a lateral view of a gun-mount designed according to the invention, with certain parts cut away for the sake of clearness, and FIG. 2 shows the lower swivel arm seen from above.

The gun-mount shown in the drawing consists of two mutually hinged swivel arms 2 and 3 rotatable around vertical axes, said swivel arms being in staggered position the one at a higher level than the other, the lower swivel arm 2 at its free end being pivotally embedded around a pivot journal 4 which is mounted in a pivot bearing 1, while the upper swivel arm 3, which is appropriately formed as a parallelogram connection, at its free end has fittings for pivotal fastening of a fork 14 for the weapon. An axle journal 5 mounted on arm 3 and pivotally embedded in arm 2, constitutes the hinging of the two swivel arms 2 and 3.

As it appears from the drawing, the axle journals 4 and 5 are provided with ratchet wheels 7 and 9 respectively, as well as chain wheels 6 and 8, around which a chain 11 has been led to establish a functional dependence of the mutual turning between the upper and the lower swivel arms 2 and 3.

The ratchet wheels 7 and 9 are designed to co-act with the ratchets 10, which by spring force mesh with the ratchet wheels in the locked position A, but which are designed to be pulled out of this locked position by turning an axle 15 pivotally embedded in the lower swivel arm, as the ratchets 10 are connected with the axle 15 by articulated rods. The axle 15 is turned appropriately by turning grips I and II fastened at the end of the axle, whereby the lock ratchets 10 can be moved to the unlocked position B. Furthermore, the axle 15 can be moved between the locked position A and the unlocked position B by means of a curved bar or grip III placed at the end of the lower swivel arm next to the pivot journal 4, which bar or grip is connected with the pivotal axle 15 through an articulated rod. In the embodiment shown in the drawing, the upper swivel arm 3 can only turn in relation to the swivel arm 2 by forced steering because of the chain 11 and the transmission ratio between the chain wheels 6 and 8, whereby because of this forced steering the ratchets always can mesh with both ratchet wheels 7 and 9 at the same time.

The two outer positions (A and B) of the axle 15 is determined by the locking device 12, which, as it appears from FIG. 2, can be a pin, which by spring force is pressed into depressions formed in the axle to block same.

We claim:

1. Gun-mount comprising two mutually hinged swivel arms in staggered position the one at a higher level than the other, the lower one of said arms at its free end being pivotally mounted around a vertical pivot journal, while the upper other arm has fittings at its free end pivotal fastening to a gun mounting fork for swivel action of the gun, coupling means including a flexible coupling element for coupling the upper and lower arms to cause them to pivot together, releasable lock means for releasable locking of the two swivel arms in an arbitrary mutually revolving position including first lock means for locking said one arm and second lock means for locking said other arm and common control means for simultaneously locking said first and second lock means, said first and second lock means being separate from said coupling means.

2. Gun-mount according to claim 1, by which mount the hinged connection between the swivel arms in an axle journal (5) fastened to the upper arm (3) and pivotally mounted on the lower arm (2), and in which the first and second lock means are ratchet wheels (9 and 7 respectively) fastened on the axle journal (5) and the pivot journal (4) respectively, as well as ratchets activated through a rod mechanism forming the control means.

3. Gun-mount according to claim 2, characterized in that the rod mechanism consists of two rods, one end of which being rotatably fastened to an axle (15) pivotally mounted on the lower swivel arm (2), the other end being linked to a ratchet (10) pressed against the ratchet wheel (9 and 7 respectively) by spring force.

4. Gun-mount according to claim 3, characterized in that the free ends of the pivotal axle are provided with grips (I, II) to be used when turning the axle (15) for releasing or locking the ratchets (10) in the ratchet wheels (9,7), as the axle (15) co-acts with a locking device (12), which is designed to keep the axle (15) in the position (A) in which the ratchets block the ratchet wheels (9 and 7 respectively) respectively in the position (B) in which the ratchets (10) are not intermeshed with the ratchet wheels (9 and 7 respectively).

5. Gun-mount according to claim 4, characterized in that a further grip (III) has been mounted at the end of the lower swivel arm (2) facing away from the hinged connection, which grip is connected with the pivotal axle (15) by an articulated rod.

6. Gun mounting apparatus, comprising:

a pair of swivel arms including an upper arm and a lower arm pivotally connected together by a pivot connection;

a gun mount adapted to mount a gun thereon and pivotally attached to the free end of the upper arm;

a support base pivotally attached to the free end of the lower arm by another pivot connection to enable said lower arm to pivot about said base;

coupling means including a flexible coupling element for coupling the two pivot connections together for pivoting said upper and lower arms;

releasable lock means including a first lock means for locking said upper arm and a second lock means for locking said lower arm in a selected rotational position relative to each other and relative to said base, and lock control means connected to both of said first and second lock means for operating said first and second lock means, said first and second lock means being separate from said coupling means.

7. Apparatus in accordance with claim 6 in which the control means is a common control means for simultaneously locking said first and second lock means.

8. Apparatus in accordance with claim 7 in which the gun mount is adapted for mounting a machine gun and the pivot connections are both vertical axis bearings.

* * * * *

UNITED STATES PATENT AND TRADEMARK OFFICE

CERTIFICATE OF CORRECTION

PATENT NO. : 4,430,922

DATED : February 14, 1984

INVENTOR(S) : JORGEN L. FOG and
JORGEN NIELSEN

It is certified that error appears in the above-identified patent and that said Letters Patent is hereby corrected as shown below:

In claims 2 to 5, delete all reference numerals corresponding to the drawings.

Signed and Sealed this

*Twenty-second* Day of *May 1984*

[SEAL]

*Attest:*

GERALD J. MOSSINGHOFF

*Attesting Officer*

*Commissioner of Patents and Trademarks*